United States Patent [19]

Körber et al.

[11] Patent Number: 4,473,130

[45] Date of Patent: Sep. 25, 1984

[54] CRASH HELMET WITH COMMUNICATION SYSTEM

[75] Inventors: Kurt A. Körber; Horst Schulz, both of Hamburg, Fed. Rep. of Germany

[73] Assignee: Hauni-Werke Körber & Co. Kg., Hamburg, Fed. Rep. of Germany

[21] Appl. No.: 430,797

[22] Filed: Sep. 30, 1982

[30] Foreign Application Priority Data

| | | | |
|---|---|---|---|
| Oct. 12, 1981 | [DE] | Fed. Rep. of Germany | 3140440 |
| Nov. 11, 1981 | [DE] | Fed. Rep. of Germany | 3144707 |
| Nov. 11, 1981 | [DE] | Fed. Rep. of Germany | 3144708 |
| Jun. 28, 1982 | [DE] | Fed. Rep. of Germany | 3224046 |

[51] Int. Cl.[3] ..... G10K 11/22

[52] U.S. Cl. ..... 181/18; 181/20; 181/21; 181/22; 181/128; 2/425

[58] Field of Search ..... 181/78, 20–22, 181/128, 196, 197, 129–137; 179/156 R, 156 A, 183; 2/425, DIG. 6

[56] References Cited

U.S. PATENT DOCUMENTS

| | | | |
|---|---|---|---|
| 1,418,388 | 6/1922 | Miessner | 181/128 X |
| 1,656,914 | 1/1928 | Hart | 181/20 |
| 3,693,748 | 9/1972 | Jones et al. | 181/20 |
| 3,993,879 | 11/1976 | Larkin | 181/20 X |

FOREIGN PATENT DOCUMENTS

| | | | |
|---|---|---|---|
| 425590 | 4/1925 | Fed. Rep. of Germany . | |
| 2612306 | 10/1976 | Fed. Rep. of Germany . | |
| 427939 | 10/1911 | France . | |
| 679502 | 4/1930 | France . | |
| 2357026 | 1/1978 | France . | |
| 2368236 | 5/1978 | France . | |
| 120253 | 10/1918 | United Kingdom . | |
| 1591712 | 6/1981 | United Kingdom | 2/DIG. 6 |

OTHER PUBLICATIONS

"Lunar Trip Lands Velcro in Industrial Role", Article by Mary Bubb, Daily New Record, P.N.R. #105, 8/4/69.

*Primary Examiner*—L. T. Hix
*Assistant Examiner*—Della Rutledge
*Attorney, Agent, or Firm*—Peter K. Kontler

[57] ABSTRACT

A crash helmet for use by motorcycle drivers or riders has a rigid shell; a first flexible acoustic tube a first section of which extends into and has a bell horn in the region of the mouth-protecting part of the shell, and a second section extending from the shell through the opening in the neck-surrounding part of the shell; a second flexible acoustic tube a first section of which extends into and has a sound-intensifying terminal portion in the region of an ear-protecting part of the shell, and a second section extending outwardly through the aforementioned opening of the shell; first and second additional flexible acoustic tubes respectively corresponding to the second and first tubes and having first sections installed in the shell of a second crash helmet; and a quick-release coupling respectively connecting the second sections of the first and second tubes with the second sections of the second and first additional tubes. The first sections of the tubes are embedded in or secured to the padding at the inner side of the respective shell.

16 Claims, 10 Drawing Figures

Fig. 1
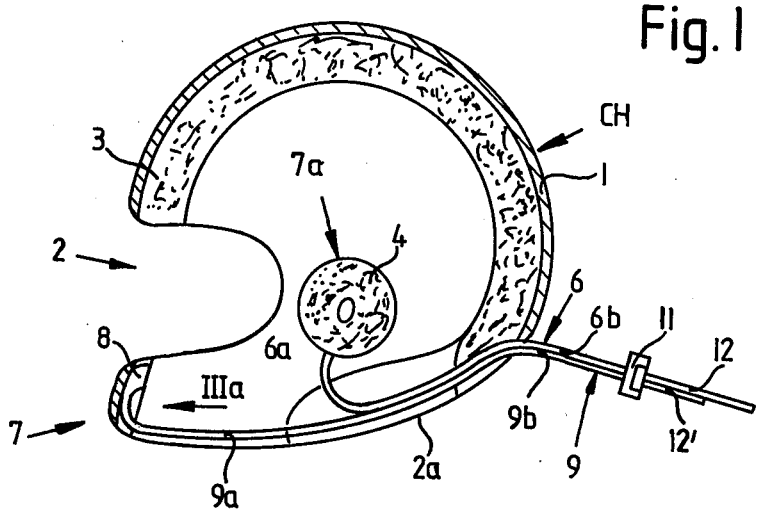
Fig.4
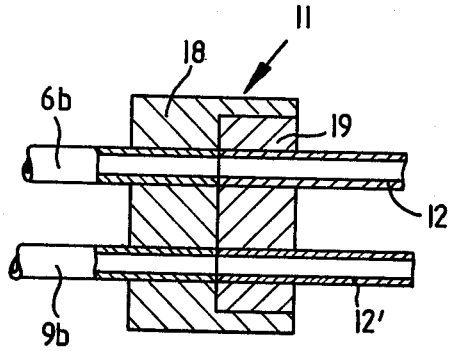
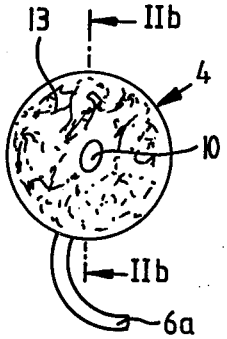
Fig.2a
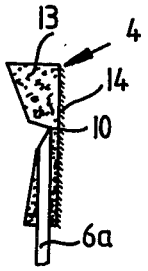
Fig.2b
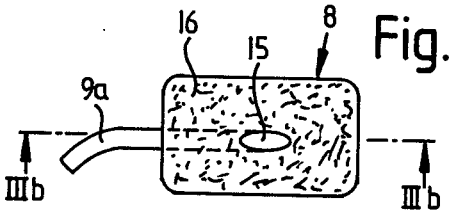
Fig.3a
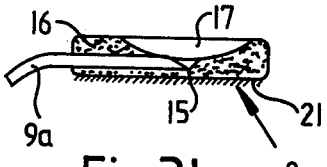
Fig.3b

CRASH HELMET WITH COMMUNICATION SYSTEM

CROSS-REFERENCE TO KNOWN PRIOR ART

At this time, applicants and their attorneys are aware of the following prior art: U.S. Pat. Nos. 1,418,388, 3,693,748 and 3,993,879; German Pat. No. 425,590; German Offenlegungsschrift No. 2,612,306; French Pat. Nos. 427,939, 679,502, 2,357,026 and 2,368,236; and British Pat. No. 120,253.

BACKGROUND OF THE INVENTION

The present invention relates to crash helmets in general, and more particularly to improvements in systems for establishing communication between the driver and another occupant of a vehicle, such as a motorcycle, snowmobile, moped, light airplane or the like. Such vehicles will be referred to hereinafter as motorcycles with the understanding, however, that the communication system can be used with equal or similar advantage in all types of conveyances which are occupied by several persons wearing crash helmets so that, in the absence of a communication system, such parties would be incapable of properly communicating with one another, e.g., due to noise which is generated by headwind, by the engine and/or by the surrounding traffic.

It is already known to provide the helmets for riders of motorcycles with devices or systems which enable such persons to communicate with one another while wearing the helmets and while the motorcycle is in motion. The majority of such systems operate on the electro-acoustical basis, i.e., it is necessary to provide a transmitter, a receiver, conductor means connecting the transmitter with the receiver, an energy source and other equipment which contributes to the bulk, weight and cost of such systems. An additional drawback of such systems is that the quality of their operation can be affected by outside influences as well as that they are likely to interfere with the communication systems which are borne by the occupants of other motorcycles.

German Offenlegungsschrift No. 2,612,306 discloses an acoustic communication system which can be used to connect two crash helmets, e.g., the helmet of the driver of a motorcycle with the helmet which is borne by the occupant of the rear seat or by the occupant of the sidecar. The communication system which is disclosed in this German publication must be placed on the head of the wearer below the crash helmet. It has been found that such proposal is far from satisfactory because the dimensions of the helmet must be increased accordingly, and also because the system on the head of the wearer interferes with freedom of movement of the head. In fact, the communication system can constitute a hazard to the wearer in the event of an accident because it is surrounded by the padding which lines the inner side of the rigid shell of the helmet; the communication system is located between the head and the padding. Still further, the communication system on the head of the wearer is unstable, i.e., it is likely to shift away from an optimum position for reception and/or transmission of sounds.

OBJECTS AND SUMMARY OF THE INVENTION

An object of the invention is to provide a novel and improved crash helmet which is combined with or incorporates a very simple, compact and inexpensive but reliable and versatile communication equipment enabling the wearer of the helmet to communicate with one or more parties occupying the same vehicle.

Another object of the invention is to provide novel and improved means for establishing audible communication between the users of two or more crash helmets without resort to a source of electrical or other energy.

A further object of the invention is to provide a crash helmet whose communication system is surprisingly simple and whose cost is but a minute fraction of the cost of heretofore known communication systems whose operation is based on electro-acoustical transmission of sound or whose operation does not require any energy sources.

An additional object of the invention is to provide a crash helmet which embodies or is combined with the aforediscussed communication system and is constructed and assembled in such a way that the provision of the communication system does not in any way affect the freedom of movement of the user of the helmet and/or represent a hazard to such person in the event of an accident.

A further object of the invention is to provide a novel and improved method of establishing communication between two or more occupants of a motorcycle or another conveyance whose operation requires or renders advisable the use of crash helmets.

An additional object of the invention is to provide a crash helmet which can be worn with equal advantage by the driver or by the occupant of the rear seat or sidecar of a motorcycle or a like conveyance.

A further object of the invention is to provide a crash helmet which embodies the aforediscussed features and whose dimensions and/or weight need not exceed those of heretofore known helmets which do not embody any communication systems.

The invention is embodied in a crash helmet for motorcycle drivers or riders. The helmet comprises a rigid protective shell which can be placed over the head of the user and includes a first portion adjacent to the mouth and second portions adjacent to the ears of the user, a first flexible acoustic tube having a first section disposed in the interior of the shell and terminating in the region of one of the aforementioned portions of the shell and a second section disposed externally of the shell, a second flexible acoustic tube disposed externally of the shell (e.g., a tube which can be connected to the helmet of a person riding with the driver of the motorcycle or a person occupying the sidecar of the motorcycle), and coupling means which separably connects the second section of the first tube with the second tube. The first tube can extend from the shell through that (open lower) portion of the shell which at least partially surrounds and protects the neck of the user.

That end portion of the first section of the first acoustic tube which is disposed in the interior of the shell can constitute or include a sound intensifying device, e.g., a megaphone, bell horn or the like.

The helmet can further comprise quick-release fastener means for securing the first section of the first acoustic tube to the one portion of the shell; such fastener means can include or constitute a Velcro (trademark) type fastener.

At least a portion of the first section of the first acoustic tube can be embedded in or bonded to the padding or cushioning material which lines the inner side of the shell.

The coupling between the first and second acoustic tubes is preferably a quick-release coupling, and the helmet can further comprise means for mounting the coupling at the exterior of the shell; such mounting means can comprise or constitute a Velcro (trademark) type fastener.

The first section of the first acoustic tube can comprise two branches one of which terminates in the region of the first portion and the other of which terminates in the region of one of the second portions of the shell.

The helmet can comprise a third acoustic tube having a first section terminating in the interior of the shell in the region of another one of the aforementioned portions of the shell and a second section disposed outside of the shell, and a fourth acoustic tube. The coupling means then preferably further comprises means for releasably connecting the second section of the third tube with the fourth tube.

Alternatively, the improved helmet can comprise a shell wherein the mouth-protecting portion has an outwardly extending hollow nipple, and a flexible acoustic tube one end portion of which is connected with such nipple and the other end portion of which can be connected to the shell of another helmet. An additional hollow nipple can be provided on and can extend outwardly from a second portion of the shell, preferably a portion which is disposed in the region of one ear of the user or in the region of the nape of the user. An additional acoustic tube is then connected to or is connectable with the other nipple and with the nipple on the mouth protecting portion of the shell forming part of the helmet. Alternatively, the first mentioned tube is then connected to or connectable with the additional nipple of the shell of such crash helmet.

In accordance with a further embodiment of the invention, the shell of the helmet can be provided with an opening in or close to the portion which protects one of the ears of the user, and such helmet further comprises a flexible acoustic tube the first end portion of which is connected to the aforementioned portion of the shell to communicate with the opening therein and the second end portion of which is connectable with the ear protecting portion of the shell forming part of a second helmet.

In accordance with an additional embodiment of the invention, the shell has a first portion adjacent to the mouth and second portions adjacent to the ears of the user, a flexible acoustic tube a first end portion of which is connected with the shell in the region of one such portion of the shell and a second end portion, and a hollow junction having a first terminal connected with the second end portion of the tube and at least one additional terminal for connection to an additional flexible acoustic tube. For example, the junction can have first and second additional terminals, and the helmet then further comprises first and second additional acoustic tubes connected with the respective additional terminals and each connectable to the shell of a discrete additional helmet.

The novel features which are considered as characteristic of the invention are set forth in particular in the appended claims. The improved crash helmet itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a substantially central vertical sectional view of a crash helmet which embodies one form of the invention;

FIG. 2*a* is an enlarged view of a detail in the helmet of FIG. 1;

FIG. 2*b* is a sectional view as seen in the direction of arrows from the line II*b*—II*b* of FIG. 2*a;*

FIG. 3*a* is an enlarged view as seen in the direction of arrow III*a* in FIG. 1;

FIG. 3*b* a sectional view as seen in the direction of arrows from the line III*b*—III*b* of FIG. 3*a;*

FIG. 4 an enlarged sectional view of a coupling for the acoustic tubes shown in FIG. 1;

DESCRIPTION OF THE PREFERRED EMBODIMENTS

Figure 5:
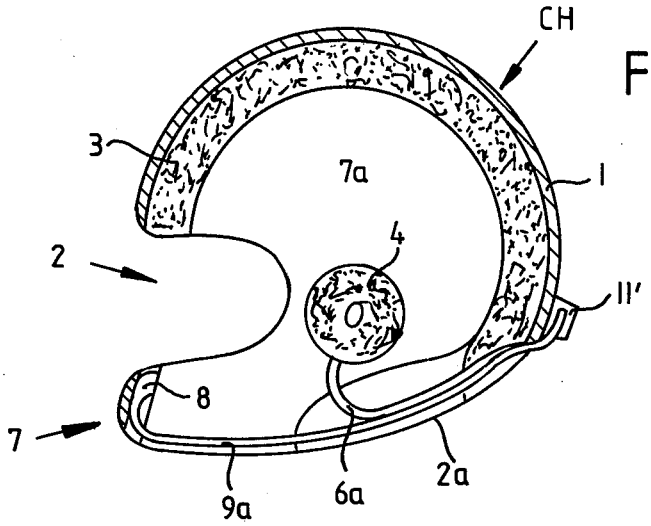
FIG. 5 is a sectional view of a slightly modified crash helmet with a coupling which is separably secured to the outer side of the shell.

Referring first to FIG. 1, there is shown a crash helmet CH which can be used by a motorcycle driver or rider, by a snowmobile driver, by a moped driver and/or for analogous purposes. The helmet CH comprises a rigid shell 1 which normally consists of a suitable synthetic plastic material and the inner side of which is lined with a suitable padding 3, e.g., a cushion consisting of foamed synthetic plastic material. The shell 1 has a front opening 2 for the nose and eyes of the user as well as an open lower portion 2*a* which surrounds the neck of the user. The reference character 7 denotes the mouth and chin protecting portion of the shell 1, and the character 7*a* denotes one of the ear protecting portions.

In accordance with a feature of the invention, the equipment which enables the user of the illustrated helmet CH to communicate with the user of a second helmet (not specifically shown) comprises a first flexible acoustic tube 6 having a section 6*a* which is located in the interior of the shell 1, and a second section 6*b* which is located externally of the shell. The tube 6 extends from the shell 1 through the open lower portion 2*a*, and the end portion 10 of the inner or first section 6*a* is installed in an ear-protecting pad 4 the details of which are shown in FIGS. 2*a* and 2*b*. As can be seen in FIG. 2*b*, a part of the section 6*a* next to the end portion 10 is embedded in the soft material of the pad 4, and the rear side of the pad 4 carries one component 14 of a quick-release fastener (preferably a Velcro (trademark) type fastener) which enables the assembler of the helmet CH to rapidly attach the part 4 to the padding 3 or directly to the inner side of the shell 1 in the region of the ear protecting portion 7*a*. The soft material of the pad 4 constitutes a substantially disc-shaped body 13 the central portion of which surrounds the end portion 10 which can constitute a sound intensifying device such as a bell horn or a megaphone. The body 13 can resemble or constitute a funnel the central portion of which receives the open end portion 10 of the section 6a so as to ensure adequate transmission of sound when the occupant of the rear seat or of the sidecar of a motorcycle (it being assumed that the illustrated helmet CH is used by the driver of the motorcycle) desires to communicate with the driver. The end portion 10 can be cut off at an acute angle so as to present an elliptical opening at the center of the funnel which is constituted or defined by the foamed body 13 of the pad 4. The arrangement is such that the body 13 of the pad 4 does not interfere with transmission of sounds to the ear of the user of the helmet CH.

The sound transmitting or communication equipment for the helmet CH further comprises a second flexible acoustic tube 9 having a first section 9a which is disposed in the interior of the shell 1 and a second section 9b which is located outside of the shell. The tube 9 extends from the shell 1 through the open lower portion 2a. The free end portion 15 of the section 9a is embedded in a soft mouthpiece 8 (see particularly FIGS. 3a and 3b) which has a body 16 preferably made of a foamed synthetic plastic material and defining a funnel 17 whose center surrounds the elliptical opening in the end portion 15. Such end portion is also cut at an angle to increase the area of the opening and constitutes a sound intensifying device adjacent to the mouth of the user of the helmet CH. The rear side of the mouthpiece 8 carries one constituent of a quick-release fastener 21 (preferably a Velcro (trademark) fastener) which enables the assembler of the communication equipment to rapidly attach the mouthpiece 8 to the padding 3 at the inner side of the shell portion 7 so that the user of the helmet CH can talk into the tube 9.

Those portions of the sections 6a and 9a of the respective acoustic tubes 6 and 9 which extend from the parts 13, 16 to the open lower portion 2a of the shell 1 are or can be embedded in the material of the padding 3 so that they are not visible at all, and especially that they do not interfere with rapid application of the shell 1 over or with rapid lifting of the shell off the head of the user. Still further, such mounting of the sections 6a, 9a (in the material of the padding 3) ensures that these sections cannot interfere with necessary movements of the head of the user, such as turning to the left or to the right, looking downwardly or upwardly, etc. The same or similar results can be achieved by bonding the sections 6a, 9a to the exposed surface of the padding 3.

The sections 6a and 9a can be said to constitute two branches of a composite acoustic tube whose exposed portion includes the sections 6b and 9b. The free ends of the exposed sections 6b and 9b are connected to the female portion 18 of a quick-release coupling 11 which is shown in greater detail in FIG. 4. The male portion 19 of this coupling can be readily extracted from the female portion 18 and carries the free ends of the second sections of two additional flexible acoustic tubes 12 and 12'. The tube 12 corresponds to the tube 9 and is connected to the padding of a second helmet in such a way that its first section terminates in the mouthpiece of the second helmet. The tube 12' corresponds to the tube 6 and its first section terminates in the region of one ear of the user of the second helmet. Thus, sound which is admitted into the section 9a is transmitted to the first section of the tube 12 and hence to the ear of the rider of the motorcycle. On the other hand, sound which is transmitted into the first section of the tube 12 at the mouthpiece of the user of the second helmet is transmitted to the pad 4 in the illustrated helmet CH. In this manner, the driver and the rider can readily communicate while the vehicle is in motion.

The illustrated quick-release coupling 11 is of the type wherein the male portion 19 is retained in the socket of the female portion 18 by friction. However, it is equally possible to employ a magnetic quick-release coupling or a quick-release coupling wherein the male and female portions are separably held together by friction as well as by magnetic force. All that counts is to ensure that the tubes 6, 9 cannot be accidentally separated from the tubes 12, 12' but such separation will inevitably take place when the need arises, e.g., in the event of an accident or when the one or the other occupant of the motorcycle forgets to separate the portions 18, 19 of the clutch from one another before the corresponding helmets are moved apart a distance exceeding the combined length of the exposed second sections of the acoustic tubes 6, 12 or 9, 12'.

The cost and bulk of the communication equipment can be reduced by the aforementioned expedient of providing a single acoustic tube which has two branches corresponding to the sections 6a, 9a and two branches also corresponding to the sections 6a and 9a but mounted in the shell of a second helmet. This still enables two occupants of the motorcycle to communicate with one another. The cost of installing the communication equipment is reduced if the sections 6a and 9a are simply bonded to the exposed inner side of the padding 3 (rather than being embedded in the material of such padding). This is especially desirable when the improved communication equipment is to be installed in existing crash helmets. However, if the communication equipment is installed at the time of assembling the helmet CH, it is advisable to embed the sections 6a, 9a in the material of the padding 3. If the equipment is not in use or not intended to be used, the openings in the end portions 10 and 15 are simply sealed off and the female portion 18 of the quick-release coupling 11 is attached to a portion of the shell 1 or padding 3 in a region where it does not interfere with movements of and/or otherwise bother the user of the helmet.

FIG. 5 illustrates a crash helmet CH which is practically identical with the similarly referenced helmet of FIG. 1. The only difference between the two helmets is that the male or female portion of a slightly modified quick release coupling 11' is preferably separably attached to the outer side of the shell 1, e.g., in the region of the nape of the user. This enables the occupant of the rear seat of the motorcycle to readily reach the coupling portion 22 on the shell 1 (it being again assumed that the helmet CH shown in FIG. 5 is worn by the driver of the motorcycle). The mounting of the coupling 11' at the outer side of the shell 1 prevents the sections 6b and 9b of the acoustic tubes 6, 9 from dangling in the region of the neck of the user of the helmet CH when the tubes 6, 9 are disconnected from the corresponding acoustic tubes 12 and 12'. Moreover, mounting of one portion (22) of the coupling 11' on the shell 1 contributes to the appearance of the helmet CH and further reduces the likelihood that the sections 6b, 9b would interfere with rapid application and/or removal of the helmet CH.

Figure 6:
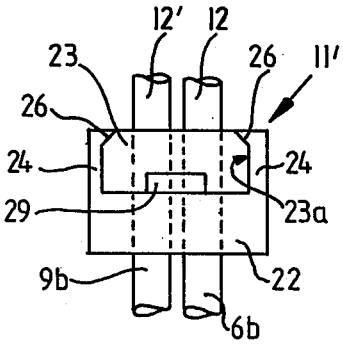
FIG. 6 is an enlarged view of the coupling shown in FIG. 5.

FIGS. 5 and 6 illustrate the details of the quick-release coupling 11'. The outer side of the shell 1 carries one component 31 of a quick-release fastener (preferably a Velcro (trademark) fastener) the other component 32 of which is applied to the adjacent side of the female portion 22 of the coupling 11'. The male portion is shown at 23. The female portion 22 has elastic lips 26 which flank the inlet of its socket 23*a* for the male portion 23 and can be readily deformed if the need arises to rapidly separate the two portions of the clutch 11', e.g., in the event of an accident. The lips 26 are provided at the free ends of preferably elastic sidewalls 24 forming part of the female portion 22 and flanking the respective sides of the aforementioned socket 23*a* in the portion 22. The end portions of the sections 6*b* and 9*b* are attached to (embedded in) the female portion 22 of the coupling 11', i.e., such sections are secured at the outer side of the shell 1 in the region of the nape of the user of the helmet CH. The male portion 23 carries the end portions of the second sections of the flexible acoustic tubes 12 and 12' in such a way that, when the portions 22 and 23 of the coupling 11' are properly assembled with one another, the tube 9 can transmit sound to the tube 12' and the tube 12 can transmit sound to the tube 6.

The male portion 23 of the coupling 11' has a protuberance 27 which enters a detent notch or bore 28 of the female portion 22 when these portions are properly assembled with one another in response to movement of the male portion 23 in the direction of arrow 34. The arrows 33 indicate the direction in which the female portion 22 must be moved toward the outer side of the shell 1 in order to move the constituents 31 and 32 of the quick-release fastener means for the portion 22 into proper engagement with one another. The protuberance 27 can be readily extracted from its notch or bore 28 in response to a pull upon the male portion 23 in a direction counter to that indicated by the arrow 34. The male portion 23 is preferably provided with a small handle 29 which can be grasped by hand, especially preparatory to extraction of the male portion 23 from the socket 23*a* of the female portion 22.

The socket 23*a* of the female portion 22 can constitute a passage which enables one end face of the male portion 23 to reach the constituent 31 of the quick-release fastener means between the female portion 22 and the shell 1 of the helmet CH. In such couplings, the front face of the male portion 23 can be provided with one constituent 36 of a quick-release (Velcro (trademark)) fastener means, and the constituent 36 moves all the way into engagement with the constituent 31 on the shell 1 to further reduce the likelihood of accidental separation of the male portion 23 from the female portion 22.

Figure 7:
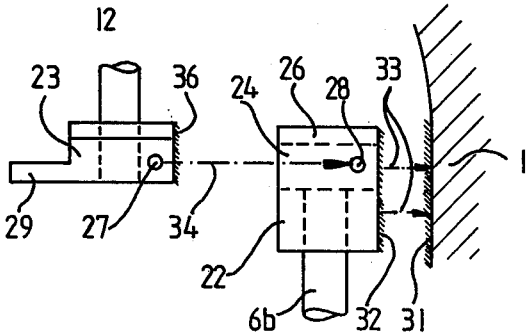
FIG. 7 is an exploded view of the coupling which is shown in FIGS. 5 and 6, and further shows a portion of the shell of the crash helmet.

Irrespective of the number of detent structures (including the lips 26, the protuberance 27 and the constituent 36), the connection between the portions 22 and 23 of the coupling 11' is such that these portions can be readily and rapidly separated from one another in response to a certain pull upon the acoustic tubes 12 and 12' and/or upon the handle 29. Thus, the coupling 11' does not and should not represent a danger to the users of the helmets which are connected to each other by the acoustic tubes 6, 9, 12 and 12' of FIGS. 5, 6 and 7. On the other hand, this coupling exhibits the aforediscussed advantages, such as keeping the sections 6*b*, 9*b* out of the way and being always within reach of the person sitting behind the person wearing the helmet CH of FIG. 5.

The acoustic tubes which are used in or with the helmet CH are preferably highly flexible hoses of small diameter. Such tubes can be readily installed in the interior of the shell 1 and occupy a minimal amount of space. Moreover, they can be readily bonded to or otherwise installed in or on the padding or directly on the shell of the helmet. Still further, small-diameter hoses do not interfere with movements of the wearer of the helmet and they can be readily laid in spaces which are available in existing types of helmets.

Figure 8:
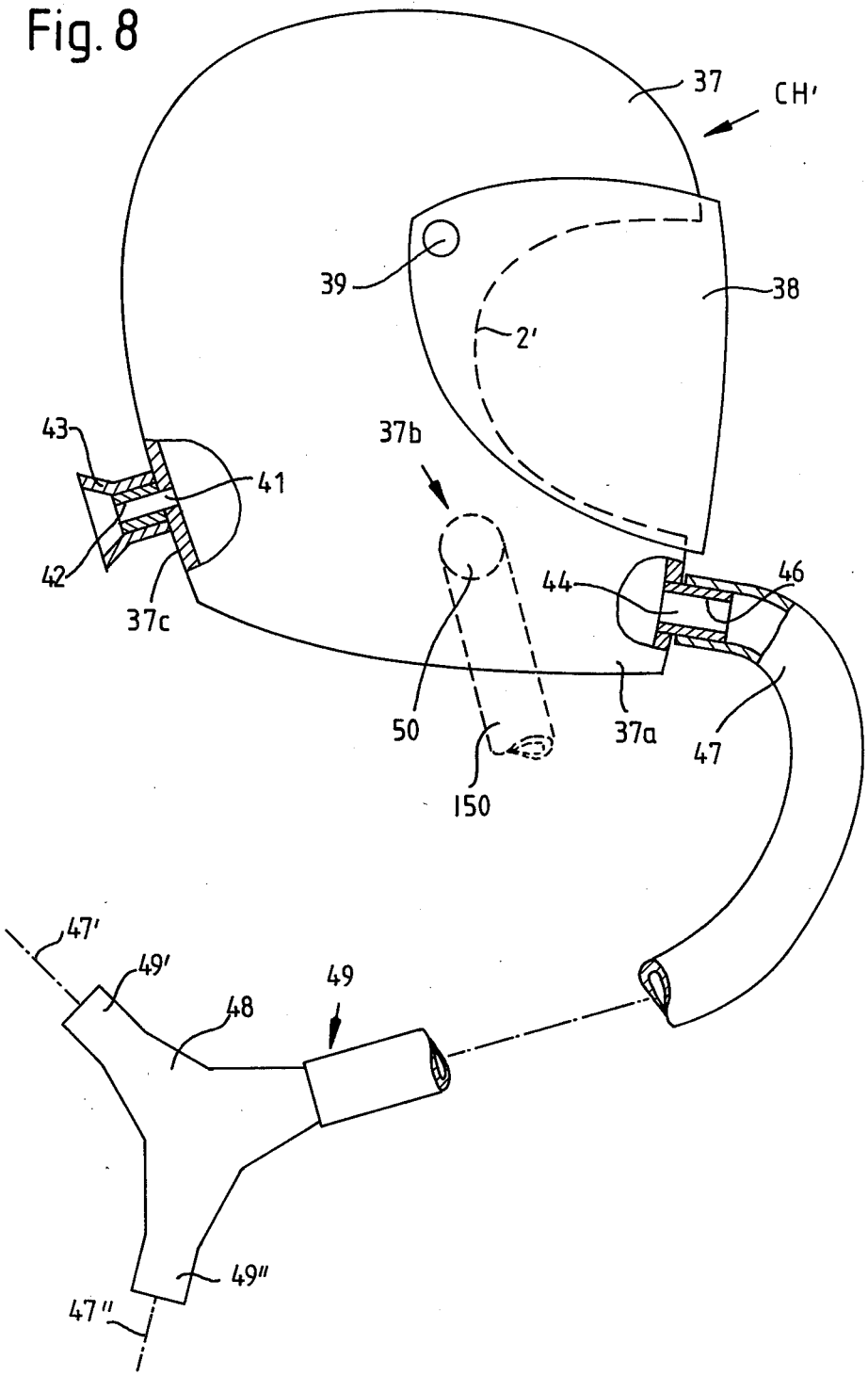
FIG. 8 is a sectional view of still another crash helmet which can be connected with several additional helmets.

FIG. 8 illustrates a modified crash helmet CH' having a rigid shell 37 and a face shield 38 which is pivotally secured to the opposite sides of the shell. One of the pivots is shown at 39; the face shield is pivotable from the illustrated operative position to a raised position in which a front opening 2' is fully or partly exposed.

The rear portion 37*c* of the shell 37 is formed with an outwardly extending hollow nipple 42 whose passage or opening 41 communicates with the interior of the shell in the region of the nape of the user of the helmet CH'. The nipple 42 carries an outwardly flaring speaking tube 43 which is close to the mouth of the occupant of the rear seat of the motorcycle so that such party can communicate with the driver by speaking into the tube 43. The speaking tube 43 can be replaced with an elongated flexible acoustic tube (corresponding to the tube 9 of FIG. 1 which then connects the nipple 42 with a mouthpiece (such as the mouthpiece 8 of FIGS. 3*a* and 3*b*)) located in or close to the mouth of the occupant of the rear seat. It has been found that the tube 43 suffices to facilitate convenient conversation between the driver and the occupant of the rear seat. Such tube 43 is preferably deformable to reduce the likelihood of injury to the occupant of the rear seat while speaking into the tube during travel of the conveyance on uneven terrain.

The mouth-protecting portion 37*a* of the shell 37 is formed with an opening 44 which is surrounded by an outwardly extending hollow nipple 46 carrying one end portion of a flexible acoustic tube 47. The other end of the tube 47 can be connected directly with the nipple 42 of a second crash helmet CH' (not shown) if the illustrated helmet CH' is worn by the occupant of the rear seat and the other helmet is worn by the driver of the motorcycle. If the illustrated helmet CH' is worn by the driver, the other end portion of the flexible tube 47 can be connected to a third nipple 50 (shown in FIG. 8 by broken lines) which is provided on and extends outwardly from or close to an ear-protecting portion 37*b* of the shell 37 forming part of a second helmet CH' which is worn by the occupant of the rear seat or by the occupant of the sidecar. The tube 47 may but need not necessarily be provided with a quick-release coupling. For example, the connection between the nipple 46 and the respective end portion of the flexible tube 47 can be said to constitute a quick-release coupling which is disengaged in automatic response to a pull upon the tube 47 in a direction to slip its end portion off the nipple 46.

In the absence of the tube 47, and if one assumes that the helmet CH' of FIG. 8 is worn by the driver of the motorcycle, the occupant of the rear seat can communicate with the driver by the simple expedient of leaning forwardly so as to be capable of talking into the tube 43 on the nipple 42. If the helmet of the occupant of the rear seat is identical with the illustrated helmet CH', it is further necessary that the occupant of the rear seat pivot the face shield 38 of his or her helmet CH' upwardly so as to be capable of talking into the tube 43 on the rear portion of the shell 37 forming part of the driver's helmet CH'. It is also possible to replace the tube 43 with a flexible acoustic tube which connects the nipple 42 of the helmet borne by the driver of the motorcycle with the nipple 46 of the helmet borne by the occupant of the rear seat. This obviates the need for bending forwardly and/or lifting of the face shield 38 when the occupant of the rear seat wishes to speak to the driver.

In order to enable a third person, such as the occupant of the sidecar, to communicate with the driver and/or with the occupant of the rear seat of the motorcycle, the flexible acoustic tube 47 of FIG. 8 can be connected to one terminal 49 of a hollow three-way junction 48 having two additional terminals 49', 49'' which are connected or connectable with two additional flexible acoustic tubes 47', 47''. For example, the tube 47' can be connected with the helmet of the occupant of the sidecar, and the tube 47'' can be connected with the helmet of the occupant of the rear seat of the motorcycle. This enables the driver to communicate with two additional parties.

It has been found that placing of the nipple 50 (which defines an opening in the shell 37) close to the region of the ear (note the ear protecting portion **37*b* of the shell 37 shown in FIG. 8) or somewhere between such region and the mouth-protecting portion 37*a* enables the user of the helmet CH' to speak to, as well as to hear from, the occupant of the rear seat or the occupant of the sidecar by resorting to a single acoustic tube, such as the tube 150 shown in FIG. 8. Let it be assumed that the flexible tube 47 of FIG. 8 is omitted and that the illustrated helmet CH' (which is presumed to be on the head of the driver of the motorcycle) is connected with a similar helmet on the head of the occupant of the rear seat or on the head of the occupant of the sidecar by a single flexible acoustic tube 150. This tube enables the driver to speak to or to receive audible signals from the occupant of the rear seat or from the occupant of the sidecar because the opening of the nipple 50 is sufficiently close to the mouth of the driver to enable the driver to speak into the tube 150, and the opening of the nipple 50 is also sufficiently close to the ear of the driver to enable the driver to hear the occupant of the rear seat or of the sidecar when such occupant decides to speak into his or her own helmet CH' so that the sound is propagated via tube 150. The nipple 50 can be omitted if the corresponding opening in the portion 37*b* is connectable with the tube 150** in another way.

It will be seen that, whereas the helmet CH necessitates the use of one or more flexible acoustic tubes in order to connect such helmet with a similar helmet, the helmet CH' can but need not employ one or more acoustic tubes. However, whereas the shell 1 of the helmet CH need not be formed with any holes or other openings for the express purpose of installing the improved communication system therein, one or more holes are needed in the helmet CH'.

An important advantage of the improved communication system is that the helmet CH or CH' constitutes a component part thereof. Thus, whereas the helmet normally constitutes that part which interferes with communication between the parties wearing the helmets, the helmet CH or CH' actually enhances such communication by directing the sound directly to the ear of the person receiving an oral communication or by facilitating the transmission of sound from the mouth of the wearer of a similar or identical helmet. One or more preferably highly flexible acoustic tubes between two or more helmets do not interfere with movements of the persons using the helmets, they do not contribute to the danger of using the helmet and/or driving the motorcycle (or another conveyance mandating the use of crash helmets), and the quality of transmitted sound is highly satisfactory in spite of the absence of any power-operated sound amplifying equipment.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A crash helmet for motorcycle drivers or riders, comprising a rigid protective shell arranged to be placed over the head of the user and including a first portion adjacent to the mouth and second portions adjacent to the ears of the user; an acoustic tube having a first section disposed in the interior of said shell and terminating in the region of one of said portions of the shell, and a second section disposed externally of said shell; a padding provided in the interior of said shell, at least a portion of said first section of said tube being embedded in or bonded to said padding; a second acoustic tube disposed externally of said shell; and coupling means separably connecting the second section of said first tube with said second tube.

2. The helmet of claim 1, wherein said shell has an open lower portion for the neck of the user and said first tube extends from the interior of the shell through said open lower portion.

3. The helmet of claim 1, wherein the first section of said first tube has an end portion located in the region of said one portion of said shell and constituting a sound intensifying device.

4. The helmet of claim 3, wherein said sound intensifying device is a bell horn.

5. The helmet of claim 1, further comprising quick-release fastener means for securing the first section of said first tube to said one portion of said shell.

6. The helmet of claim 5, wherein said fastener means includes a Velcro (trademark) type fastener.

7. The helmet of claim 1, wherein said coupling means includes a quick-release coupling.

8. The helmet of claim 1, further comprising means for mounting said coupling at the exterior of said shell.

9. The helmet of claim 8, wherein said mounting means comprises a Velcro (trademark) type fastener.

10. The helmet of claim 1, wherein the first section of said first tube includes two branches one of which terminates in the region of the first portion and the other of which terminates in the region of one of said second portions of said shell.

11. The helmet of claim 1, further comprising a third acoustic tube having a first section terminating in the interior of said shell in the region of another of said portions of the shell and a second section disposed outside of said shell, and a fourth acoustic tube, said coupling means including means for releasably connecting the second section of said third tube with said fourth tube.

12. A crash helmet for motorcycle drivers or riders, comprising a rigid protective shell arranged to be placed over the head of a user and including a mouth-protecting portion in the region of the mouth of the user, said portion having an outwardly extending hollow nipple; and an acoustic tube having an end portion connected with said nipple.

13. The helmet of claim 12, wherein said shell further includes a second portion disposed in the region of one ear of the user and having an outwardly extending hollow nipple.

14. The helmet of claim 12, wherein said shell further includes additional portions disposed in the regions of the ears and the nape of the user, at least one of said additional portions having an outwardly extending hollow nipple.

15. The helmet of claim 14, further comprising an additional acoustic tube connected with said additional nipple, said additional tube being connectable with the nipple of the mouth-protecting portion of the shell forming part of a second helmet and said first mentioned tube being connectable with the nipple of the additional portion of the shell of such second helmet.

16. A crash helmet for motorcycle drivers or riders, comprising a rigid protective shell arranged to be placed over the head of a user and including a first portion adjacent to the mouth and second portions adjacent to the ears of the user; a flexible acoustic tube having a first end portion connected with said shell in the region of one of said portions of the shell and a second end portion; a hollow junction having a first terminal connected with the second end portion of said tube and first and second additional terminals; and first and second additional flexible acoustic tubes each connectable with the shell of a discrete additional helmet.

* * * * *